US007902959B2

(12) United States Patent
Yamada et al.

(10) Patent No.: US 7,902,959 B2
(45) Date of Patent: Mar. 8, 2011

(54) RADIO COMMUNICATION SYSTEM OF WATER HEATER

(75) Inventors: Tomomi Yamada, Nagoya (JP); Keiji Kato, Nagoya (JP)

(73) Assignee: Rinnai Corporation, Nagoya-shi (JP)

( * ) Notice: Subject to any disclaimer, the term of this patent is extended or adjusted under 35 U.S.C. 154(b) by 958 days.

(21) Appl. No.: 11/752,557

(22) Filed: May 23, 2007

(65) Prior Publication Data

US 2007/0295823 A1 Dec. 27, 2007

(30) Foreign Application Priority Data

May 26, 2006 (JP) ..... 2006-146127

(51) Int. Cl.
*G08C 19/00* (2006.01)

(52) U.S. Cl. ..... 340/3.7; 340/3.71

(58) Field of Classification Search ..... 340/825.69, 340/825.72, 3.7, 3.71, 584, 586; 341/175, 341/176; 237/7, 8 A
See application file for complete search history.

(56) References Cited

U.S. PATENT DOCUMENTS

2002/0070875 A1* 6/2002 Crumb ..... 340/825.69
2002/0175828 A1* 11/2002 Macey ..... 340/825.72
2004/0267385 A1* 12/2004 Lingemann ..... 700/83
2005/0253682 A1 11/2005 Kato et al.
2005/0255831 A1 11/2005 Kato et al.

FOREIGN PATENT DOCUMENTS

| | | |
|---|---|---|
| JP | 04-172899 | 6/1992 |
| JP | 2004-132671 | 4/2004 |
| JP | 2005-328295 | 11/2005 |
| JP | 2005-328296 | 11/2005 |

* cited by examiner

*Primary Examiner* — Edwin C Holloway, III
(74) *Attorney, Agent, or Firm* — Turocy & Watson, LLP

(57) ABSTRACT

A radio communication system of a water heater comprising a slave set which remotely operates a water heater main body by radio communication, and a master set which continuously communicates with the water heater main body by wired communication and which intermittently communicates with the slave set by radio communication to relay communication between the water heater main body and the slave set, wherein after the slave set instructs to change a hot water supply temperature of the water heater main body to a requested temperature by the salve set, the requested temperature previously instructed by the slave set is maintained as the hot water supply temperature displayed on the display section of the slave set for a particular time until the hot water supply temperature of the water heater main body reaches the temperature requested by the slave set.

3 Claims, 5 Drawing Sheets

FLOW OF MASTER SET

RADIO COMMUNICATION SYSTEM OF WATER HEATER

BACKGROUND OF THE INVENTION

1. Field of the Invention

The present invention relates to a radio communication system of a water heater including a slave set which remotely operates a water heater main body by radio communication, and a master set which continuously communicates with the water heater main body by wired communication and which intermittently communicates with the slave set by radio communication to relay communication between the water heater main body and the slave set.

2. Description of the Related Art

As a conventional water heater, since an indoor wiring operation of a remote control unit is unnecessary and installation is easy, and besides a remote control unit can easily be provided for an already installed water heater, there is known a radio communication system in which the outdoor water heater main body is remotely operated by radio communication using an indoor slave set (radio remote control unit) while relaying the master set of the outdoor water heater.

For example, as shown in FIG. 5, the radio communication system of this kind includes a master set 103 which is connected with a wire communication line 106 to an electronic unit 102 of the water heater main body 101 and which communicates with the water heater main body 101 by wired communication, and a slave set 105 which communicates with the master set 103. Wire communication is continuously performed between the master set 103 by radio communication and the water heater main body 101, and radio intermittent communication is performed between the master set 103 and the slave set 105. The intermittent communication between the master set 103 and the slave set 105 is kept in timing-synchronization on the side of the slave set 105 based on a transmission-start time point information included in radio data from the master set 103, indicative of the start time point of the next data transmission (e.g., Japanese Patent Application Laid-open No. 2005-328296).

Therefore, when operation information given by switching operation of the slave set 105 is transmitted to the master set 103 by radio intermittent communication, an operation instruction from the master set 103 is immediately transmitted to the water heater main body 101 by full-time wire communication. Then, the water heater main body 101 performs an operation according to the operation instruction. The monitor information (such as combustion operation state, stoppage state of combustion, and hot water supply temperature) of the water heater main body 101 is continuously received by full-time wire communication with by the master set 103, and is transmitted to the slave set 105 by radio intermittent communication from the master set 103. With this configuration, the slave set 105 can periodically obtain the latest monitor information of the water heater main body 101, and the monitor information is displayed on the display section of the slave set 105. In this manner, the master set 103 operates to relay the communication such that the outdoor water heater main body 101 is remotely operated by the slave set 105, i.e. the radio remote control unit, and that the monitor information of the water heater main body 101 is displayed on the slave set 105, in the above-mentioned radio communication system.

Some kinds of the water heater main body can change the setting of the hot water supply temperature only by 1° C. Also, it is desired to suppress the abrupt change in temperature of outgoing hot water by finely controlling the combustion in the water heater main body 101 even if the setting of the hot water temperature is changed during the supply of hot water. In response thereto, as shown FIG. 5, there is known a water heater main body 101 which operates such that if the hot water supply temperature is changed by the slave set 105, the master set 103 instructs the water heater main body 101 to change the hot water supply temperature of the water heater main body 101 little by little (e.g., by 1° C.). In this kinds of the water heater, since the master set 103 continuously communicates with the water heater main body 101, the master set 103 continuously receives the monitor information from the water heater main body 101 even while the master set 103 is transmitting data to the water heater main body 101. The master set 103 transmits the monitor information of the water heater main body 101 of the transmission timing to the slave set 105 at the transmission timing of the radio intermittent communication with the slave set 105. Therefore, depending on the transmission timing of the master set 103, monitor information of the water heater main body 101 can be transmitted to the slave set 105 from the master set 103 in a state where the change of the hot water supply temperature in the water heater main body 101 has not yet been completed.

For example, if the hot water supply temperature of the water heater main body 101 is changed from the current value of 40° C. to 50° C. in the slave set 105, the master set 103 automatically transmits an operation instruction to change the hot water supply temperature by "+1° C." to the water heater main body 101 ten times successively so that the hot water supply temperature of the water heater main body 101 is changed from 40° C. to 50° C. Even when the hot water supply temperature of the water heater main body 101 has been changed only to 43° C. at the intermittent communication timing, the master set 103 transmits monitor information indicating that "hot water supply temperature is 43° C." to the slave set 105. However, the slave set 105 displays setting information in the slave set 105 and monitor information transmitted from the master set 103 on the same display section. Thus, in the display section of the slave set 105, since the hot water supply temperature is changed to 50° C. first, displayed contents indicating that "hot water supply temperature is 50° C." is rewritten to "hot water supply temperature is 43° C." by the monitor information received from the master set 103. Therefore, when a user sees the displayed contents, in which the hot water supply temperature should have been set to 50° C. by the slave set 105, is changed to 43° C., the user feels suspicious or uncomfortable and may mistakenly believe that the slave set 105 is out of order.

To avoid such a problem, it can be considered that the slave set 105 does not receive radio data from the master set 103 for certain period. However, in this case, the slave set 105 does not also receive transmission-start time point information indicative of a next data transmission time point from the master set 103. Thus, there arises a problem that communication timing of the intermittent communication between the slave set 105 and the master set 103 cannot be in synchronization with each other.

SUMMARY OF THE INVENTION

The present invention has been made in view of the above circumstances, and the invention provides a radio communication system of a water heater having excellent usability in which a hot water supply temperature displayed by operation of a slave set is not changed by subsequent radio data from a master set without hindrance of the communication timing of intermittent communication between the slave set and the master set.

According to one aspect of the present invention, there is provided a radio communication system of a water heater comprising a slave set which remotely operates a water heater main body by radio communication, and a master set which continuously communicates with the water heater main body by wires communication and which intermittently communicates with the slave set by radio communication to relay communication between the water heater main body and the slave set, wherein the slave set includes a switch section for remotely operating the water heater main body, a display section for displaying operation information at the switch section and monitor information of the water heater main body, a slave set radio communication circuit which intermittently communicates with the master set by radio communication, and a slave set communication control section for controlling in synchronization with communication timing of the master set;

the master set includes a wire communication circuit which continuously communicates with the water heater main body by wired communication, a master set radio communication circuit which intermittently communicates with the slave set by radio communication, and a master set communication control section which continuously receives monitor information of the water heater main body from the water heater main body and which controls such that the received monitor information is intermittently transmitted to the slave set together with transmission-start time point information indicative of next data transmission time point;

after the slave set instructs to change a hot water supply temperature of the water heater main body to a predetermined requested temperature, the requested temperature previously instructed by the slave set is maintained as the hot water supply temperature displayed on the display section of the slave set for a particular time until the hot water supply temperature of the water heater main body reaches the temperature requested by the slave set.

Other objects, features and advantages of the present invention will become more fully understood from the detailed description given hereinbelow and the accompanying drawings which are given by way of illustration only, and thus are not to be considered as limiting the present invention.

DETAILED DESCRIPTION OF THE PREFERRED EMBODIMENTS

In a radio communication system of a water heater according to the present invention, after the slave set requests to change a hot water supply temperature of the water heater main body to a predetermined temperature, the temperature previously requested by the slave set is maintained as the hot water supply temperature displayed on the display section of the slave set for a particular time until the hot water supply temperature of the water heater main body reaches the temperature requested by the slave set.

An embodiment of the radio communication system of the water heater according to the invention will be explained below.

Embodiment 1

Figure 1:
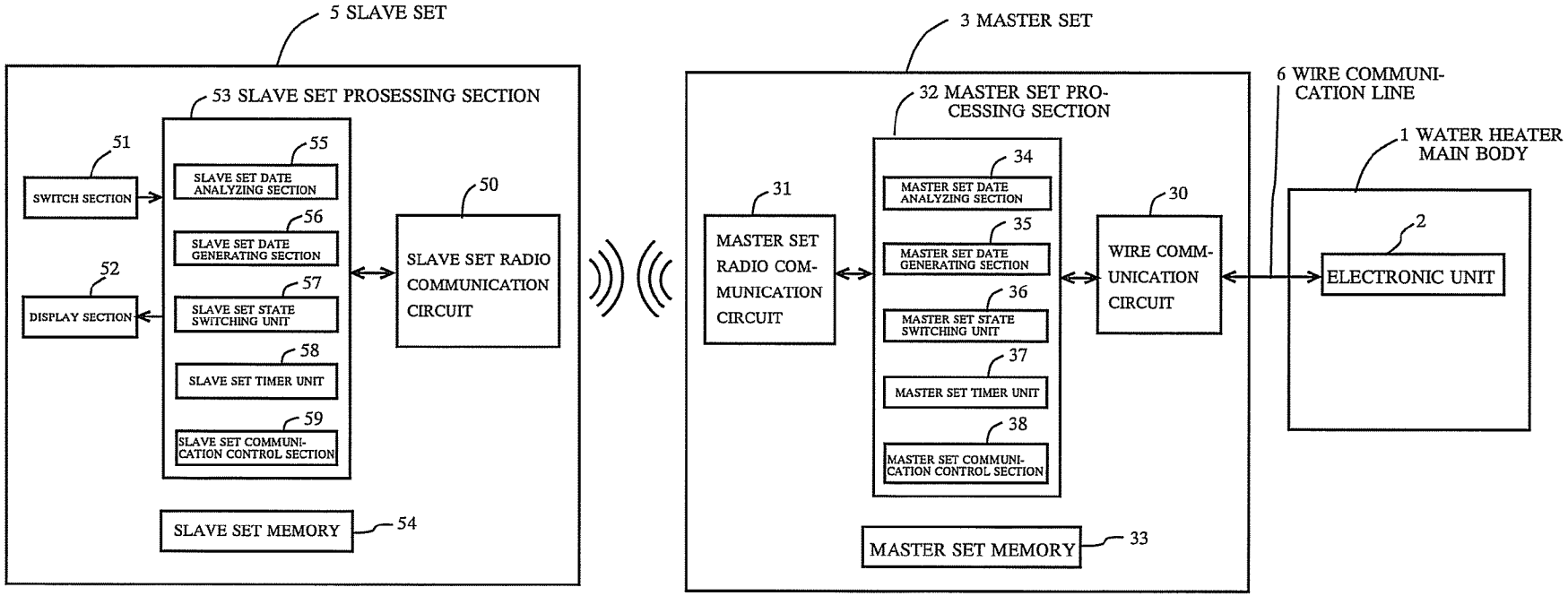
FIG. 1 is a block diagram of a radio communication system of a water heater according to an embodiment of the present invention.

As Shown in FIG. 1, a Radio Communication System of a Water Heater according to a first embodiment of the present invention includes a master set 3 which communicates with the water heater main body 1 by wired communication, and a slave set 5 as a radio remote control unit which performs radio communicates with the master set 3 by radio communication. The radio communication system enables to establish communication between the slave set 5 and the water heater main body 1 through the master set 3 relaying the communication.

The water heater main body 1 includes a combustion burner, a heat exchanger, a water passage (not shown), and an electronic unit 2 which controls operation of the water heater main body 1. The master set 3 is connected to the electronic unit 2 of the water heater main body 1 through a wired communication line 6 such as a communication cable. The master set 3 is connected to the water heater main body 1 through a power cord, and power is supplied to the master set 3 from the side of the water heater main body 1. The slave set 5 and the master set 3 are paired by means of ID code registration so that radio communication can be performed correctly therebetween. A battery is disposed in the slave set 5 and power is supplied to the slave set 5 from the battery. The master set 3 is usually installed outdoor near the water heater main body 1. A plurality of slave sets 5 may be provided in a kitchen or in a bathroom as the radio remote control units.

The master set 3 includes a wire communication circuit 30 which continuously communicates with the water heater main body 1 by wired communication, a master set radio communication circuit 31 which intermittently communicates with the slave set 5 by radio communication, a master set processing section 32, and a master set memory 33.

The master set processing section 32 of the master set 3 includes a master set data analyzing section 34 for analyzing main body wire data which is continuously received from the water heater main body 1 and slave set radio data which is received from the slave set 5, a master set data generating section 35 for generating master set radio data to be transmitted to the slave set 5 and master set wire data to be transmitted to the water heater main body 1, a master set state switching unit 36 for switching the master set radio communication circuit 31 between a data-sendable state in which data can be transmitted to the slave set 5 and a data-receivable state in which data from the slave set 5 can be received, a master set timer unit 37 for counting communication timing, and a master set communication control section 38.

The master set communication control section 38 of the master set 3 performs control such that monitor information of the water heater main body 1 is continuously received from the water heater main body 1 and the monitor information is intermittently transmitted to the slave set 5 together with the transition-start time point information indicative of a next data transmission time point.

The master set communication control section 38 performs control in the following way. When the master set 3 receives, from the slave set 5, an instruction to change the hot water supply temperature of the water heater main body 1 to a requested temperature, the master set communication control section 38 transmits to the water heater main body 1 an operation instruction to change the hot water supply temperature of the water heater main body 1 little by little until the hot water supply temperature reaches the temperature requested by the slave set 5, whereas to the slave set 5, the master set communication control section 38 transmits the temperature requested by the slave set 5 instead of the hot water supply temperature of the water heater main body 1 including the monitor information for a particular time until the hot water supply temperature of the water heater main body 1 reaches the temperature requested by the slave set 5, and after the particular time elapses, the monitor information indicative of the hot water supply temperature of the water heater main body 1 is transmitted.

The slave set 5 includes a slave set radio communication circuit 50 which intermittently communicates with the master set 3 by radio communication, a switch section 51 for remotely operating the water heater main body 1, a display section 52 for displaying operation information in the switch section 51 and monitor information of the water heater main body 1, a slave set processing section 53, and a slave set memory 54.

The slave set processing section 53 of the slave set 5 includes a slave set data analyzing section 55 for analyzing operation information in the switch section 51 and master set radio data intermittently received from the master set 3, a slave set data generating section 56 for generating slave set radio data to be transmitted to the master set 3 and display data in the display section 52, a slave set state switching unit 57 for switching the slave set radio communication circuit 50 between a data-sendable state in which data can be transmitted to the master set 3, a data-receivable state in which data from the master set 3 can be received and a standby state in which data cannot be transmitted to and from the master set 3, a slave set timer unit 58 for counting communication timing, and a slave set communication control section 59 for controlling in synchronization with communication timing of the master set 3.

Figure 2:
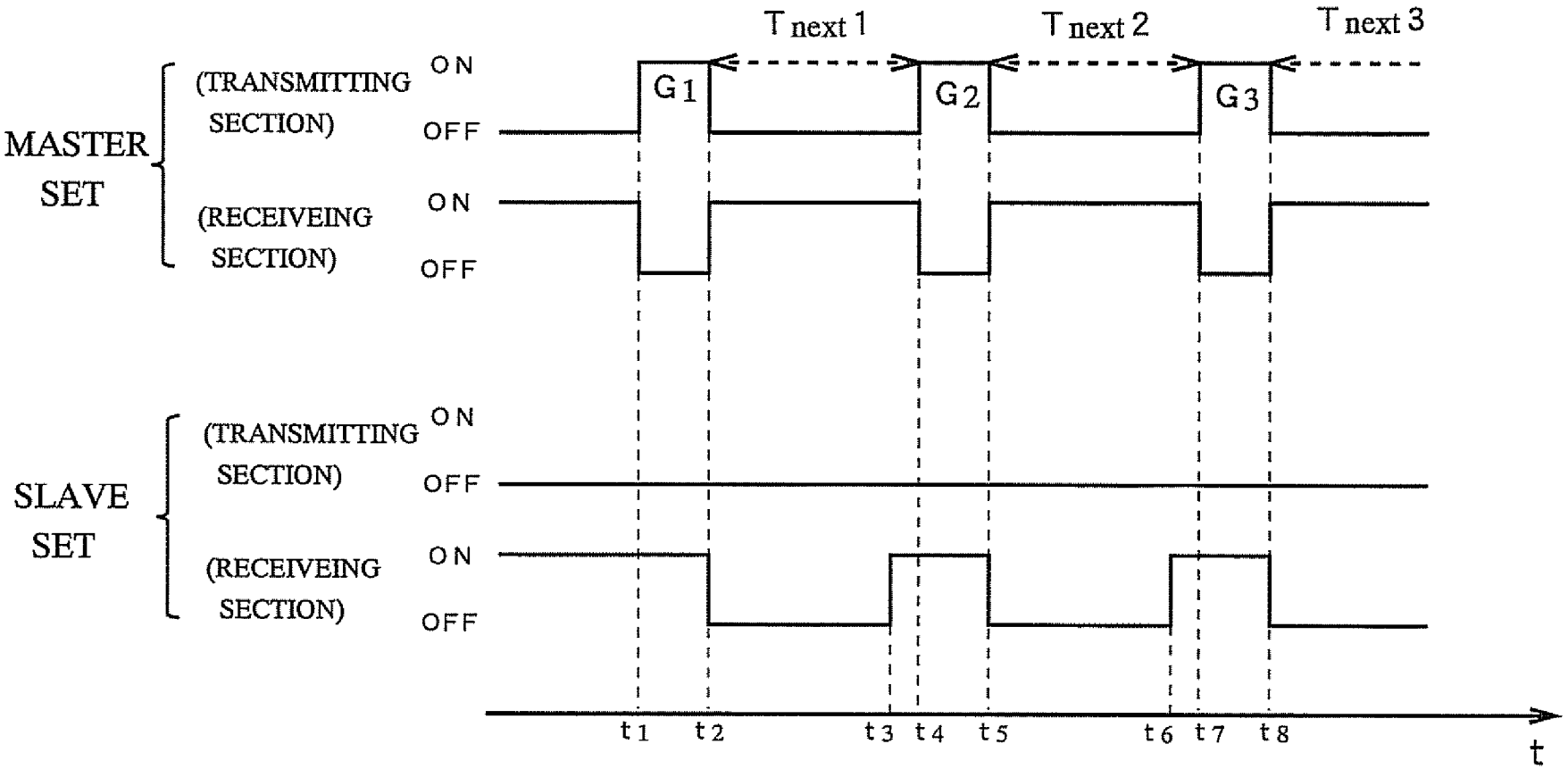
FIG. 2 is a timing chart showing communication timing between a master set and a slave set when switching operation is not performed in the slave set of the radio communication system of the water heater according to the embodiment.

If a transmitting section of the master set radio communication circuit 31 is turned ON and a receiving section thereof is turned OFF by the master set state switching unit 36, the master set 3 is set to a data-sendable state to the slave set 5, and if the transmitting section of the master set radio communication circuit 31 is turned OFF and the receiving section thereof is turned ON, the master set 3 is set to the data-receivable state from the slave set 5 (see FIG. 2). If a transmitting section of the slave set radio communication circuit 50 is turned ON and a receiving section thereof is turned OFF by the slave set state switching unit 57, the slave set 5 is set to the data-sendable state to the master set 3, and if the transmitting section of the slave set radio communication circuit 50 is turned OFF and the receiving section thereof is turned ON, the slave set 5 is set to the data-receivable state from the master set 3, and if the transmitting section and the receiving section of the slave set radio communication circuit 50 are both turned OFF, the slave set 5 is set to the standby state in which radio communication between the master set 3 cannot be performed (see FIGS. 2 and 3). When the slave set 5 is in the standby state, power supply to the slave set radio communication circuit 50 is cut off, and power consumption of the slave set 5 is suppressed during that time.

Next, exchange of data between the slave set 5, the master set 3 and the water heater main body 1 will be explained.

Since communication between the master set 3 and the water heater main body 1 is continuous communication, the master set 3 continuously receives main body wire data indicative of monitor information of the water heater main body 1 (such as combustion operation state, stoppage state of combustion, and hot water supply temperature) from the water heater main body 1.

On the other hand, as shown in FIG. 2, since communication established between the master set 3 and the slave set 5 is intermittent communication, the master set 3 brings the master set radio communication circuit 31 into the data-sendable state, and transmits the master set radio data G including the monitor information of the water heater main body 1 to the slave set 5. The master set radio data G 3 also includes transmission-start time point information $T_{next}$ indicative of time point at which the master set radio data G is transmitted next (starting time point at which a data-sendable state is established next). Therefore, the slave set 5 switches the slave set radio communication circuit 50 from the data-receivable state to the standby state when the reception of the master set radio data G is completed (t2, t5, t8 . . . ). Based on the transmission-start time point information $T_{next}$, the slave set 5 again switches, immediately before (t3, t6 . . . ) the master set radio data G is transmitted next, the slave set radio communication circuit 50 to the data-receivable state to prepare for receiving the next master set radio data G from the master set 3. The transmission-start time point information $T_{next}$ may be indicative of time interval from transmitting operation completion time point (t2, t5 . . . ) of the master set radio data G (G1, G2 . . . ) to next transmitting operation-starting time point (t4, t7 . . . ) of the master set radio data G (G2, G3 . . . ), or may be indicative of transmitting operation-starting time (time of t4, t7 . . . ) of the next master set radio data G.

In this manner, the slave set 5 intermittently receives the master set radio data G from the master set 3 in synchronization with the intermittent transmission timing of the master set 3. The slave set 5 displays the monitor information of the water heater main body 1 included in the master set radio data G received from the master set 3 on the display section 52.

Figure 3:
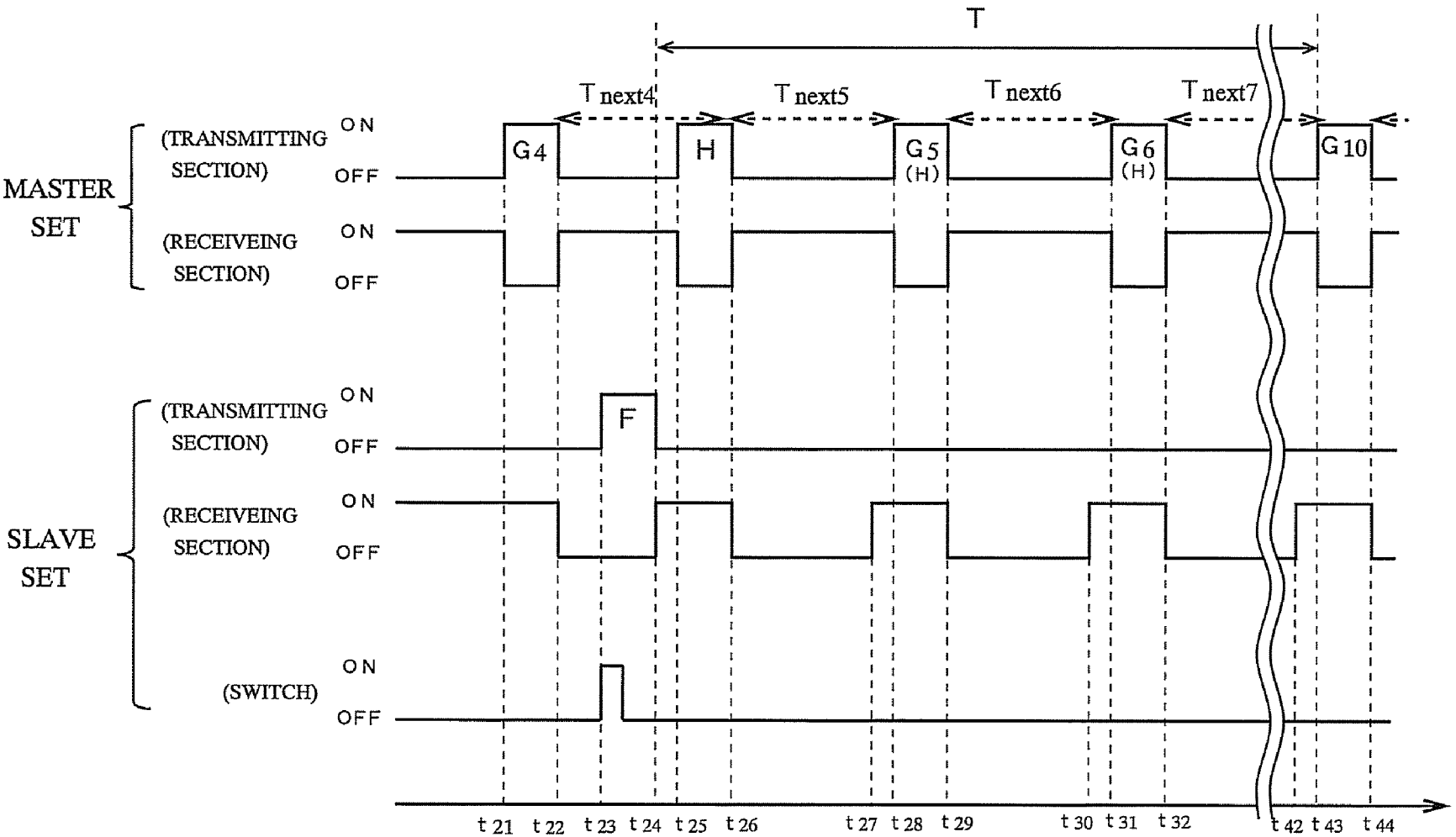
FIG. 3 is a timing chart showing communication timing between the master set and the slave set when the switching operation is performed in the slave set of the radio communication system of the water heater according to the embodiment.

As shown in FIG. 3, when the switch section 51 of the slave set 5 is operated to remotely operate the water heater main body 1, the slave set 5 switches the slave set radio communication circuit 50 from the standby state to the data-sendable state upon turning the switch section 51 ON (t23), and transmits slave set radio data F including the operation information according to the turned ON switch section 51 to the master set 3. At the same time, the slave set 5 allows the display section 52 to display the operation information in the switch section 51. When the switching operation of the slave set 5 is performed in the data-receivable state of the slave set 5, the slave set 5 transmits the slave set radio data F to master set 3 after the data receiving operation is completed.

At this time, since the master set 3 is in the data-receivable state from the slave set 5, if the master set 3 receives the slave set radio data F, the master set 3 returns, to the slave set 5, the operation information of the slave set 5 included in the slave set radio data F for confirmation of reception as return data H together with the transmission-start time point information $T_{next}$ ($T_{next5}$), and the master set 3 transmits, to the water heater main body 1, operation instruction of the water heater main body 1 according to the operation information included in the slave set radio data F together with the master set wire data by the full-time communication. In this case, communication between the master set 3 and the water heater main body 1 is continuous communication, the master set 3 can transmit the master set wire data to the water heater main body 1 even during receiving main body wire data including the monitor information from the water heater main body 1. With this configuration, the water heater main body 1 performs predetermined operation in accordance with the operation instruction, the water heater main body 1 is remotely operated by the slave set 5. The monitor information of the water heater main body 1 is not included in the return data H.

When the master set 3 transmits the return data H, the master set 3 transmits the return data H to the slave set 5 irrespective of the transmission time point of the transmission-start time point information $T_{next}$ ($T_{next4}$) included in the previous master set radio data G (G4). When the transmission of the slave set radio data F is completed, the slave set 5 switches the slave set radio communication circuit 50 from the data-sendable state to the data-receivable state and prepares for receiving the return data H from the master set 3. Therefore, when the reception of the return data H from the master set 3 is completed, the slave set 5 switches the slave set radio communication circuit 50 from the data-receivable state to the standby state, and when no switching operation is performed, communication timing with respect to the master set 3 is adjusted based on the transmission-start time point information $T_{next}$ ($T_{next5}$) included in the return data H.

The slave set 5 displays the operation information in the slave set 5 included in the return data H on the display section 52. The displayed contents at this time match the contents to be displayed when the switching operation is performed in the slave set 5, and thus the display on the display section is not changed.

The master set 3 may include a display flashing signal in the return data H. With this signal, a display of the operation information in the slave set 5 included in the return data H flashes in the display section 52 of the slave set 5, whereby confirmation of data reception at the master set 3 can clearly be indicated.

When the master set 3 receives an instruction (slave set radio data F) from the slave set 5 to change the hot water supply temperature of the water heater main body 1 to a requested temperature, the master set 3 transmits to the water heater main body 1 an operation instruction (master set wire data) to change the hot water supply temperature of the water heater main body 1 little by little until the hot water supply temperature reaches the temperature requested by the slave set 5, whereas to the slave set 5, transmits the temperature requested by the slave set 5 (master set radio data G5(H), G6(H) . . . ) instead of the hot water supply temperature of the water heater main body 1 included in the monitor information until a particular time T elapses (see FIG. 3).

Here, the temperature requested by the slave set 5 is the hot water supply temperature to be set in the water heater main body 1. When hot water is supplied, the water heater main body 1 controls operations of various portions such that the temperature of hot water at the outgoing hot water opening (outgoing hot water temperature) reaches the hot water supply temperature. Therefore, the requested temperature is the hot water supply temperature to be set in the water heater main body 1, but is also the temperature of actual hot water which comes out from the outgoing hot water opening (outgoing hot water temperature).

Figure 4:
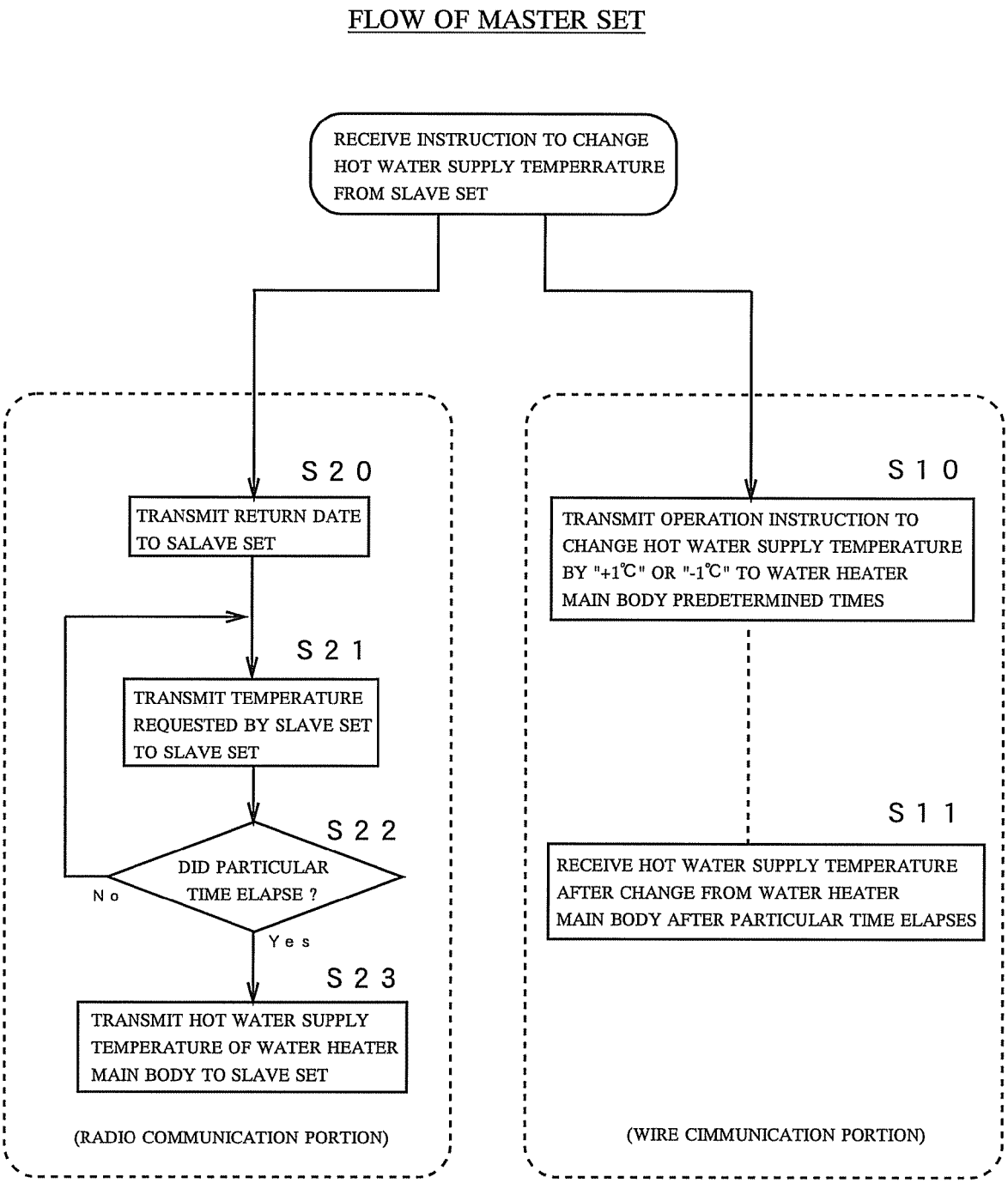
FIG. 4 is a flowchart showing operation in the master set when a hot water supply temperature is changed in the slave set of the radio communication system of the water heater according to the embodiment.
Figure 5:
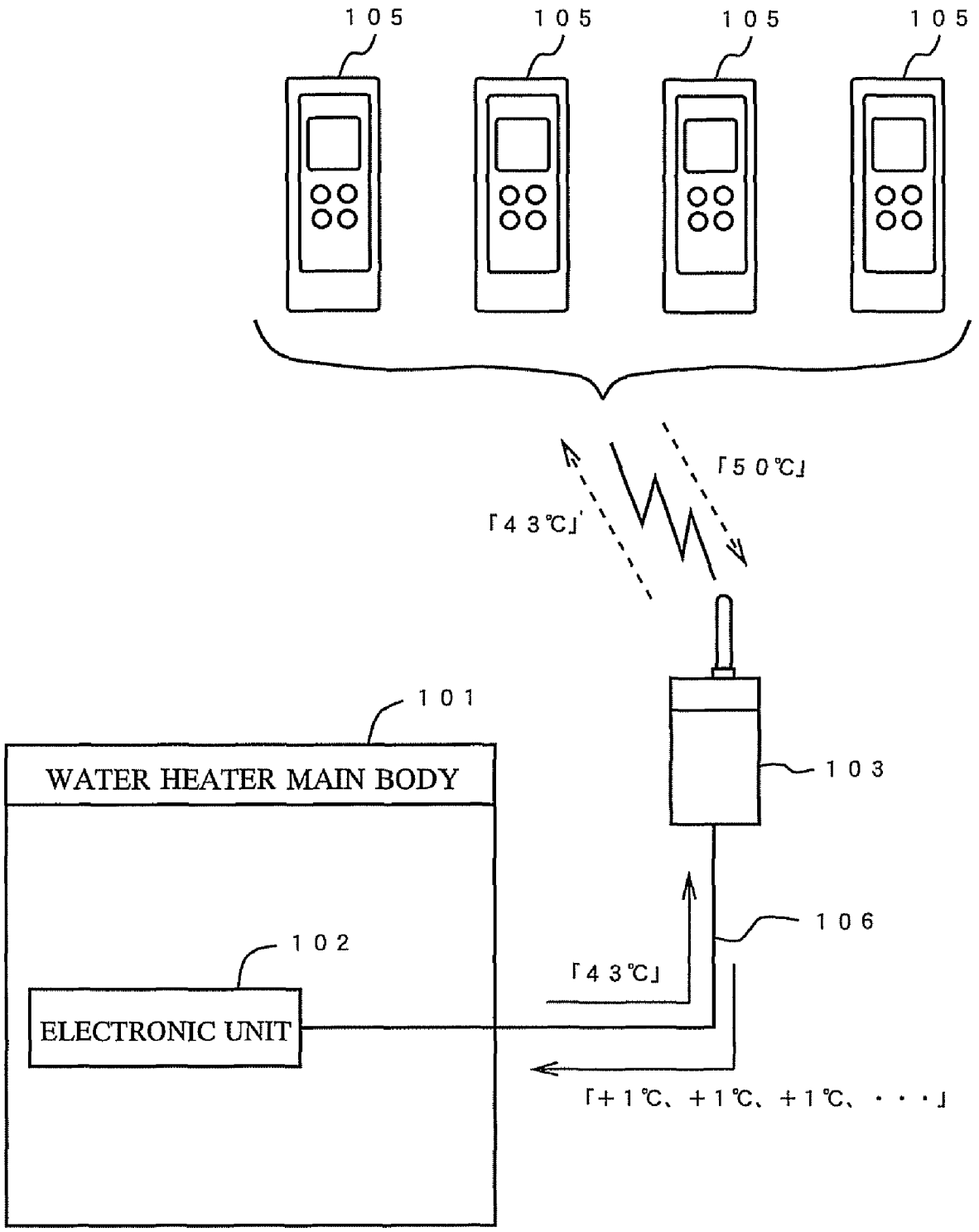
FIG.5 PRIOR ART
FIG. 5 is a block diagram showing an entire structure of a conventional radio communication system of a water heater.

More specifically, when the hot water supply temperature of the water heater main body 1 is changed by the slave set 5, as shown in the right side of the flowchart in FIG. 4, the master set 3 automatically and successively transmits, to the water heater main body 1, master set wire data of the operation instruction to change the hot water supply temperature by "+1° C." or "−1° C." so that the current hot water supply temperature of the water heater main body 1 which is continuously received is changed little by little, e.g. by 1° C., at the wire communication portion with the water heater main body 1 (S10). In this manner, in the water heater main body 1, the set hot water supply temperature is changed little by little by 1° C. in the water heater main body 1. For example, when the hot water supply temperature is changed from 40° C. to 50° C. by the slave set 5, the master set 3 transmits successively ten times, to the water heater main body 1, master set wire data of operation instruction to change the hot water supply temperature which is set in the water heater main body 1 by "+1° C." until the hot water supply temperature of the water heater main body 1 is changed to 50° C.

On the other hand, as shown in the left side of the flowchart in FIG. 4, in the radio communication portion with the slave set 5, the master set 3 transmits the return data H (in this case, the temperature requested by the slave set 5 as the hot water supply temperature) (S20), and intermittently transmits, to the slave set 5, the temperature requested by the slave set 5 (e.g., "hot water supply temperature: 50° C.") in the slave set radio data F included in the master set radio data G5(H), G6(H) . . . instead of the hot water supply temperature of the water heater main body 1 which is continuously received from the water heater main body 1 (S21, 22: see FIG. 3) until a particular time T (e.g. 5 seconds) elapses. By this operation, the slave set 5 displays, on the display section 52, the temperature requested by the slave set 5 included in the master set radio data G5(G), G6(H) . . . received from the master set 3 as the hot water supply temperature of the water heater main body 1. In this case, the hot water supply temperature displayed on the display section 52 of the slave set 5 is the same as the temperature requested by the slave set 5 previously switched by the slave set 5, and thus the hot water supply temperature displayed on the display section 52 of the slave set 5 does not change.

The particular time T is set to be the length of time during which the hot water supply temperature of the water heater main body 1 reaches the temperature requested by the slave set 5, i.e., the length of time during which the master set 3 completes all data transmission of operation instruction to change the hot water supply temperature little by little to the water heater main body 1 and the hot water supply temperature of the water heater main body 1 which is continuously received by the master set 3 is changed to the temperature requested by the slave set 5, or a longer time. Therefore, the particular time T can be set appropriately by communication environment of the wire communication line 6 between the master set 3 and the water heater main body 1.

After the particular time T elapses, the master set 3 intermittently transmits, to the slave set 5, the hot water supply temperature of the water heater main body 1 which is continuously received from the water heater main body 1 included in the master set radio data G10 (S23: see FIG. 3). The hot water supply temperature of the water heater main body 1 at this time has already been changed to the temperature requested by the slave set 5 because the particular time T elapsed (S11). Thus, even when the slave set 5 displays the hot water supply temperature of the water heater main body 1 on the display section 52 based on the master set radio data G10 received from the master set 3, since the hot water supply temperature displayed on the display section 52 of the slave set 5 in this case matches the temperature requested by the slave set 5 which was previously switched by the slave set 5, the hot water supply temperature displayed on the display section 52 of the slave set 5 does not change.

As described above, when the hot water supply temperature of the water heater main body 1 is changed by the slave set 5, even if an operation instruction to change the hot water supply temperature of the water heater main body 1 little by little is transmitted to the water heater main body 1 from the master set 3, the master set 3 transmits the temperature requested by the slave set 5 to the slave set 5 until the particular time elapses, without transmitting the hot water supply temperature in progress to the slave set 5. In this case, the temperature requested by the slave set 5 received from the master set 3 is displayed as the hot water supply temperature of the water heater main body 1 on the display section 52 of the slave set 5. That is, the hot water supply temperature displayed on the display section 52 of the slave set 5 is the requested temperature which was instructed and set by the slave set 5 previously.

According to the radio communication system of the first embodiment, in the slave set 5, even when an instruction to change the hot water supply temperature is transmitted, the hot water supply temperature as requested by the slave set 5 is always displayed. Therefore, the problem in the conventional systems that, when an instruction to change the hot water supply temperature is transmitted, the hot water supply temperature is rewritten to the hot water supply temperature of the water heater main body 1 in progress for a certain time does not occur, and the user neither feels suspicious or uncomfortable, nor mistakenly believes that the slave set 5 is out of order. In this case, since the slave set 5 obtains the transmission-start time point information $T_{next}$ included in the master set radio data G or the return data H received from the master set 3, the communication timing of the intermittent communication between the slave set 5 and the master set 3 is not hindered. Thus, the radio communication system according to this embodiment has excellent usability for users.

Embodiment 2

In a radio communication system of a water heater according to a second embodiment, if the master set 3 receives, from the slave set 5, slave set radio data F having an instruction to change the hot water supply temperature of the water heater main body 1 to a requested temperature, the master set 3 does not transmit to the slave set 5, except the return data H, master set radio data G including monitor information of the water heater main body 1 which is continuous received from the water heater main body 1.

That is, transmission-start time point information $T_{next}$ (corresponding to $T_{next5}$ in FIG. 3) indicative of time point at which the master set radio data G is transmitted next is included in the return data H, the transmission-start time point information $T_{next}$ at this time is set to a long time so that the time point at which master set radio data G is transmitted next is after the time point at which the particular time T elapsed (for example, in FIG. 3, the transmission-start time point information $T_{next5}$ included in the return data H is the time point at which master set radio data G10 including monitor information of the water heater main body 1 is to be transmitted after the return data H).

With this configuration, the master set 3 does not transmit, to the slave set 5, the hot water supply temperature which is continuously received from the water heater main body 1 until the particular time T elapsed. Then, the hot water supply temperature of the water heater main body 1 is changed to the temperature requested by the slave set 5 by the full-time communication between the master set 3 and the water heater main body 1 during the particular time T. After the particular time T elapsed, the master set 3 transmits, to the slave set 5, the continuously received hot water supply temperature of the water heater main body 1 included in the master set radio data G. When the slave set 5 receives the master set radio data G, the slave set 5 displays the hot water supply temperature of the water heater main body 1 received from the master set 3 on the display section 52. In this case, since the hot water supply temperature displayed on the display section 52 of the slave set 5 matches the requested temperature displayed when the switching operation was performed by the slave set 5 previously, the hot water supply temperature displayed on the display section 52 of the slave set 5 does not change. Other structure and operation are the same as those of the first embodiment.

As described above, since the hot water supply temperature of the water heater main body 1 is transmitted to the slave set 5 from the master set 3 after the particular time elapsed, the hot water supply temperature of the water heater main body 1 at this time point has already been changed to the temperature requested by the slave set 5. In this case, the hot water supply temperature of the water heater main body 1 received from the master set 3 is displayed on the display section 52 of the slave set 5, and the hot water supply temperature displayed on the display section 52 of the slave set 5 matches the requested temperature which was instructed and set by the slave set 5 previously.

In the radio communication system of the second embodiment also, even when an instruction to change the hot water supply temperature is given by the slave set 5, the display on the display section 52 is not rewritten to the hot water supply temperature of the water heater main body 1 in progress, and the display of the hot water supply temperature as requested by the slave set 5 is always maintained. In this case, since the slave set 5 obtains master set radio data G received from the master set 3 and transmission-start time point information $T_{next}$ included in the return data H, the communication timing of the intermittent communication between the slave set 5 and the master set 3 is secured as it is. Therefore, the radio communication system according to this embodiment has excellent usability for users.

Embodiment 3

In a radio communication system of a water heater according to a third embodiment, if the master set 3 receives, from the slave set 5, slave set radio data F having an instruction to change a hot water supply temperature of the water heater main body 1 to a requested temperature, the master set 3 transmits, to the slave set 5, monitor information of the water heater main body 1 (including hot water supply temperature of the water heater main body 1) included in the master set radio data G on predetermined intermittent communication timing.

On the other hand, when the slave set 5 transmits the slave set radio data F to the master set 3, the slave set 5 receives master set radio data G from the master set 3 on predetermined intermittent communication timing, but the slave set 5 invalidates (deletes, erases, does not receive) the hot water supply temperature data of the water heater main body 1 included in the master set radio data G until a particular time T (the same as that of the first embodiment) elapses.

With this configuration, the slave set processing section 53 invalidates the hot water supply temperature data in progress included in the master set radio data G received by the slave set 5. Thus, the hot water supply temperature of the water heater main body 1 in progress is not displayed on the display section 52 of the slave set 5. Therefore, the display of the hot water supply temperature same as requested by the slave set 5 is always maintained on the display section 52 of the slave set 5. In this case, since the slave set 5 obtains master set radio data G received from the master set 3 and transmission-start time point information $T_{next}$ included in the return data H, the communication timing of the intermittent communication between the slave set 5 and the master set 3 is secured as it is. Therefore, the radio communication system according to this embodiment has excellent usability for users. Other structure and operation are the same as those of the first embodiment.

Other Embodiments

In the embodiments of the present invention, when the master set 3 transmits, to the water heater main body 1, an operation instruction to change a hot water supply temperature little by little, the hot water supply temperature may be changed not only by 1° C., but also by 2° C., or the hot water supply temperature may be changed by 1° C. up to a certain hot water supply temperature and thereafter it may be changed by 2° C.

In the embodiments of the present invention, if it is requested to change the hot water supply temperature of the water heater main body 1 by the slave set 5, the display of the hot water supply temperature on the display section 52 may flash until the particular time T elapses. The flash of the displayed temperature may be performed by including a display flash command signal in the master set radio data G, or may be processed by the slave set processing section 53 of the slave set 5.

With this configuration, while the hot water supply temperature in the display section 52 of the slave set 5 is flashing, it is possible to recognize that the hot water supply temperature of the water heater main body 1 is being set, and if the flashing display of the display section 52 changes to the normal lighting display, it is possible to recognize that the setting operation of the hot water supply temperature in the water heater main body 1 has been completed. Thus, the user can recognize the processing in the water heater main body 1 by the slave set 5 and may feel comfortable, and a system having more excellent usability is provided for the user.

As described in detail above, according to one aspect of the present invention, there is provided a radio communication system of a water heater comprising a slave set which remotely operates a water heater main body by radio communication, and a master set which continuously communicates with the water heater main body by wired communication and which intermittently communicates with the slave set by radio communication to relay communication between the water heater main body and the slave set, wherein the slave set includes a switch section for remotely operating the water heater main body, a display section for displaying operation information at the switch section and monitor information of the water heater main body, a slave set radio communication circuit which intermittently communicates with the master set by radio communication, and a slave set communication control section for controlling in synchronization with communication timing of the master set;

the master set includes a wire communication circuit which continuously communicates with the water heater main body by wired communication, a master set radio communication circuit which intermittently communicates with the slave set by radio communication, and a master set communication control section which continuously receives monitor information of the water heater main body from the water heater main body and which controls such that the received monitor information is intermittently transmitted to the slave set together with transmission-start time point information indicative of next data transmission time point;

after the slave set instructs to change a hot water supply temperature of the water heater main body to a predetermined requested temperature, the requested temperature previously instructed by the slave set is maintained as the hot water supply temperature displayed on the display section of the slave set for a particular time until the hot water supply temperature of the water heater main body reaches the temperature requested by the slave set.

As described above, when the hot water supply temperature of the water heater main body is changed by the slave set, even when an operation instruction to change the hot water supply temperature of the water heater main body little by little is transmitted to the water heater main body from the master set, the hot water supply temperature displayed on the display section of the slave set is not changed by the master set radio data received from the master set. Further, the communication timing between the slave set and the master set is also secured as it is.

Therefore, when it is instructed to change the hot water supply temperature by the slave set, a problem that the hot water supply temperature displayed in the slave set is rewritten to the hot water supply temperature of the water heater main body in progress does not occur, and a system having excellent usability for users can be provided.

According to a first embodiment of the present invention, there is provided a radio communication system of a water heater comprising a slave set which remotely operates a water heater main body by radio communication, and a master set which continuously communicates with the water heater main body by wired communication and which intermittently communicates with the slave set by radio communication to relay communication between the water heater main body and the slave set, wherein the slave set includes a switch section for remotely operating the water heater main body, a display section for displaying operation information at the switch section and monitor information of the water heater main body, a slave set radio communication circuit which intermittently communicates with the master set by radio communication, and a slave set communication control section for controlling in synchronization with communication timing of the master set;

the master set includes a wire communication circuit which continuously communicates with the water heater main body by wired communication, a master set radio communication circuit which intermittently communicates with the slave set by radio communication, and a master set communication control section which continuously receives monitor information of the water heater main body from the water heater main body and which controls such that the received monitor information is intermittently transmitted to the slave set together with transmission-start time point information indicative of next data transmission time point;

the master set communication control section of the master set controls such that when the master set receives an instruction from the slave set to change a hot water supply temperature of the water heater main body to a requested temperature by the slave set, an operation instruction to change the hot water supply temperature of the water heater main body little by little is transmitted to the water heater main body until the hot water supply temperature reaches the temperature requested by the slave set, and the temperature requested by the slave set is transmitted to the slave set instead of the hot water supply temperature of the water heater main body including the monitor information until a particular time during which the hot water supply temperature of the water heater main body reaches the temperature requested by the slave set elapses.

According to the above configuration, when the hot water supply temperature of the water heater main body is changed by the slave set, even if an operation instruction to change the hot water supply temperature of the water heater main body little by little is transmitted to the water heater main body from the master set, the hot water supply temperature of the water heater main body in progress is not transmitted to the slave set until the particular time elapses, and the temperature requested by the slave set is transmitted. In this case, the temperature requested by the slave set received from the master set is displayed as the hot water supply temperature of the water heater main body on the display section of the slave set. That is, the hot water supply temperature displayed on the display section of the slave set is the requested temperature which was instructed and set by the slave set previously.

In this case, since the slave set obtains the transmission-start time point information received from the master set, the communication timing of the intermittent communication between the slave set and the master set is not hindered.

As described above, when the hot water supply temperature of the water heater main body is changed by the slave set, even when an operation instruction to change the hot water supply temperature of the water heater main body little by little is transmitted to the water heater main body from the master set, the hot water supply temperature displayed on the display section of the slave set is not changed by the master set radio data received from the master set. Further, the communication timing between the slave set and the master set is also secured as it is.

Therefore, when it is instructed to change the hot water supply temperature by the slave set, a problem that the hot water supply temperature displayed in the slave set is rewritten to the hot water supply temperature of the water heater main body which has not yet been changed does not occur, and a system having excellent usability for users can be provided.

In the radio communication system of the water heater according to the first embodiment of the present invention, after the particular time elapses, the master set communication control section of the master set may controls so as to transmit the monitor information indicative of the hot water supply temperature of the water heater main body to the slave set.

According to the above configuration, when the hot water supply temperature of the water heater main body is changed by the slave set, even if an operation instruction to change the hot water supply temperature of the water heater main body little by little is transmitted to the water heater main body from the master set, the hot water supply temperature of the water heater main body in progress is not transmitted to the slave set until the particular time elapses, and the temperature requested by the slave set is transmitted. In this case, the temperature requested by the slave set received from the master set is displayed as the hot water supply temperature of the water heater main body on the display section of the slave set. That is, the hot water supply temperature displayed on the display section of the slave set is the requested temperature which was instructed and set by the slave set previously.

Also, since the hot water supply temperature of the water heater main body is transmitted to the slave set from the master set after the particular time elapsed, the hot water supply temperature of the water heater main body at this time point has already been changed to the temperature requested by the slave set. In this case, the hot water supply temperature of the water heater main body received from the master set is displayed on the display section of the slave set and thus, the hot water supply temperature displayed on the display section of the slave set matches the requested temperature which was instructed and set by the slave set previously.

Further, in this case, since the slave set obtains the transmission-start time point information received from the master set, the communication timing of the intermittent communication between the slave set and the master set is not hindered.

As described above, when the hot water supply temperature of the water heater main body is changed by the slave set, even when an operation instruction to change the hot water supply temperature of the water heater main body little by little is transmitted to the water heater main body from the master set, the hot water supply temperature displayed on the display section of the slave set is not changed by the master set radio data received from the master set. The communication timing between the slave set and the master set is also secured as it is.

Therefore, when it is instructed to change the hot water supply temperature by the slave set, a problem that the hot water supply temperature displayed in the slave set is rewritten to the hot water supply temperature of the water heater main body in progress does not occur, and a system having excellent usability for users can be provided.

According to a second embodiment of the present invention, there is provided a radio communication system of a water heater comprising a slave set which remotely operates a water heater main body by radio communication, and a master set which continuously communicates with the water heater main body by wired communication and which intermittently communicates with the slave set by radio communication to relay communication between the water heater main body and the slave set, wherein the slave set includes a switch section for remotely operating the water heater main body, a display section for displaying operation information at the switch section and monitor information of the water heater main body, a slave set radio communication circuit which intermittently communicates with the master set by radio communication, and a slave set communication control section for controlling in synchronization with communication timing of the master set;

the master set includes a wire communication circuit which continuously communicates with the water heater main body by wired communication, a master set radio communication circuit which intermittently communicates with the slave set by radio communication, and master set communication control section which continuously receives monitor information of the water heater main body from the water heater main body, and which controls such that the received monitor information is intermittently transmitted to the slave set together with transmission-start time point information indicative of next data transmission time point;

the master set communication control section of the master set controls such that when the master set receives an instruction from the slave set to change a hot water supply temperature of the water heater main body to a requested temperature by the slave set, an operation instruction to change the hot water supply temperature of the water heater main body little by little is transmitted to the water heater main body until the hot water supply temperature reaches the temperature requested by the slave set, and monitor information indicative of the hot water supply temperature of the water heater main body is transmitted to the slave set after a particular time during which the hot water supply temperature of the water heater main body reaches the temperature requested by the slave set.

According to the above configuration, when the hot water supply temperature of the water heater main body is changed by the slave set, even if an operation instruction to change the hot water supply temperature of the water heater main body little by little is transmitted to the water heater main body from the master set, the hot water supply temperature of the water heater main body is transmitted to the slave set from the master set after the particular time elapsed. Thus, the hot water supply temperature of the water heater main body at this time point has already been changed to the temperature requested by the slave set. In this case, the hot water supply temperature of the water heater main body received from the master set is displayed on the display section of the slave set, and the hot water supply temperature displayed on the display section of the slave set matches the requested temperature which was instructed and set by the slave set previously.

In this case, since the slave set obtains the transmission-start time point information received from the master set, the communication timing of the intermittent communication between the slave set and the master set is not hindered.

As described above, when the hot water supply temperature of the water heater main body is changed by the slave set, even when an operation instruction to change the hot water supply temperature of the water heater main body little by little is transmitted to the water heater main body from the master set, the hot water supply temperature displayed on the display section of the slave set is not changed by the master set radio data received from the master set. The communication timing between the slave set and the master set is also secured as it is.

Therefore, when it is instructed to change the hot water supply temperature by the slave set, a problem that the hot water supply temperature displayed in the slave set is rewritten to the hot water supply temperature of the water heater main body in progress does not occur, and a system having excellent usability for users can be provided.

According to a third embodiment of the present invention, there is provided a radio communication system of a water heater comprising a slave set which remotely operates a water heater main body by radio communication, and a master set which continuously communicates with the water heater main body by wired communication and which intermittently communicates with the slave set by radio communication to relay communication between the water heater main body and the slave set, wherein the slave set includes a switch section for remotely operating the water heater main body, a display section for displaying operation information at the switch section and monitor information of the water heater main body, a slave set radio communication circuit which intermittently communicates with the master set by radio communication, a slave set communication control section for controlling in synchronization with communication timing of the master set, and a slave set processing section;

the master set includes a wire communication circuit which continuously communicates with the water heater main body by wired communication, a master set radio communication circuit which intermittently communicates with the slave set by radio communication, and master set communication control section which continuously receives monitor information of the water heater main body from the water heater main body and which controls such that as master set radio data the received monitor information is intermittently transmitted to the slave set together with transmission-start time point information indicative of next data transmission time point;

the master set communication control section of the master set controls such that when the master set receives an instruction from the slave set to change a hot water supply temperature of the water heater main body to a requested temperature by the slave set, an operation instruction to change the hot water supply temperature of the water heater main body little by little is transmitted to the water heater main body until the hot water supply temperature reaches the temperature requested by the slave set; and after the instruction to change temperature is transmitted to the master set from the slave set, the slave set processing section of the slave set invalidates the hot water supply temperature data of the water heater main body included in the master set radio data until a particular time during which the hot water supply temperature of the water heater main body reaches the temperature requested by the slave set elapses.

With this configuration, the slave set processing section invalidates the hot water supply temperature data in progress which is included in the master set radio data received by the slave set. Thus, the hot water supply temperature of the water heater main body in progress is not displayed on the display section of the slave set. Therefore, the display of the hot water supply temperature as requested by the slave set is always maintained on the display section of the slave set. Further, in this case, since the slave set obtains the transmission-start time point information received from the master set, the communication timing of the intermittent communication between the slave set and the master set is not interfered.

As described above, when the hot water supply temperature of the water heater main body is changed by the slave set, even when an operation instruction to change the hot water supply temperature of the water heater main body little by little is transmitted to the water heater main body from the master set, the hot water supply temperature displayed on the display section of the slave set is not changed by the master set radio data received from the master set. The communication timing between the slave set and the master set is also secured as it is.

Therefore, when it is instructed to change the hot water supply temperature by the slave set, a problem that the hot water supply temperature displayed in the slave set is rewritten to the hot water supply temperature of the water heater main body in progress does not occur, and a system having excellent usability for users can be provided.

The present application claims priority based on a Japanese Patent Application No. 2006-146127 filed on May 26, 2006, the content of which is hereby incorporated by reference in its entirely.

Although the present invention has been described in detail, the foregoing descriptions are merely exemplary at all aspects, and do not limit the present invention thereto. It should be understood that an enormous number of unillustrated modifications may be assumed without departing from the scope of the present invention.

What is claimed is:

1. A radio communication system of a water heater comprising a slave set which remotely operates a water heater main body by radio communication, and a master set which continuously communicates with the water heater main body by wired communication and which intermittently communicates with the slave set by radio communication to relay communication between the water heater main body and the slave set, wherein the slave set includes a switch section for remotely operating the water heater main body, a display section for displaying operation information at the switch section and monitor information of the water heater main body, a slave set radio communication circuit which intermittently communicates with the master set by radio communication, and a slave set communication control section for controlling in synchronization with communication timing of the master set;

the master set includes a wire communication circuit which continuously communicates with the water heater main body by wired communication, a master set radio communication circuit which intermittently communicates with the slave set by radio communication, and a master set communication control section which continuously receives monitor information of the water heater main body from the water heater main body and which controls such that the received monitor information is intermittently transmitted to the slave set together with transmission-start time point information indicative of next data transmission time point;

the master set communication control section of the master set controls such that when the master set receives an instruction from the slave set to change a hot water supply temperature of the water heater main body to a requested temperature by the slave set, an operation instruction to change the hot water supply temperature of the water heater main body little by little is transmitted to the water heater main body until the hot water supply temperature reaches the temperature requested by the slave set, and the temperature requested by the slave set is transmitted to the slave set instead of the hot water supply temperature of the water heater main body including the monitor information until a particular time during which the hot water supply temperature of the water heater main body reaches the temperature requested by the slave set elapses.

2. The radio communication system of the water heater according to claim 1, wherein after the particular time elapses, the master set communication control section of the master set controls so as to transmit the monitor information indicative of the hot water supply temperature of the water heater main body to the slave set.

3. A radio communication system of a water heater comprising a slave set which remotely operates a water heater main body by radio communication, and a master set which continuously communicates with the water heater main body by wired communication and which intermittently communicates with the slave set by radio communication to relay communication between the water heater main body and the slave set, wherein the slave set includes a switch section for remotely operating the water heater main body, a display section for displaying operation information at the switch section and monitor information of the water heater main body, a slave set radio communication circuit which intermittently communicates with the master set by radio communication, a slave set communication control section for controlling in synchronization with communication timing of the master set, and a slave set processing section;

the master set includes a wire communication circuit which continuously communicates with the water heater main body by wired communication, a master set radio communication circuit which intermittently communicates with the slave set by radio communication, and master set communication control section which continuously receives monitor information of the water heater main body from the water heater main body and which controls such that as master set radio data the received monitor information is intermittently transmitted to the slave set together with transmission-start time point information indicative of next data transmission time point;

the master set communication control section of the master set controls such that when the master set receives an instruction from the slave set to change a hot water supply temperature of the water heater main body to a requested temperature by the slave set, an operation instruction to change the hot water supply temperature of the water heater main body little by little is transmitted to the water heater main body until the hot water supply temperature reaches the temperature requested by the slave set;

and after the instruction to change temperature is transmitted to the master set from the slave set, the slave set processing section of the slave set invalidates the hot water supply temperature data of the water heater main body included in the master set radio data until a particular time during which the hot water supply temperature of the water heater main body reaches the temperature requested by the slave set elapses.

* * * * *